US005503280A

United States Patent [19]

Hanano et al.

[11] Patent Number: 5,503,280

[45] Date of Patent: Apr. 2, 1996

[54] TIMED THRUST UNCOUPLING MECHANISM FOR PASSENGER TRANSIT TYPE RAILWAY CARS

[75] Inventors: M. Nihad Hanano; Richard J. Mazur, both of Greer; Conley L. McGee, Simpsonville, all of S.C.

[73] Assignee: Westinghouse Air Brake Company, Wilmerding, Pa.

[21] Appl. No.: 233,243

[22] Filed: Apr. 26, 1994

[51] Int. Cl.[6] ..... B61G 3/00

[52] U.S. Cl. ..... 213/77; 213/212; 213/211

[58] Field of Search ..... 213/211, 212, 213/213, 214, 216, 77, 100 R

[56] References Cited

U.S. PATENT DOCUMENTS

| | | | |
|---|---|---|---|
| 1,403,657 | 1/1922 | Van Dorn | 213/212 |
| 2,161,724 | 6/1939 | Scharfenberg | 213/77 |
| 2,746,615 | 5/1956 | Heimaster et al. | 213/212 |
| 3,724,680 | 4/1973 | Hines | 213/212 |
| 5,152,410 | 10/1992 | Ta et al. | 213/212 |

FOREIGN PATENT DOCUMENTS

| | | | |
|---|---|---|---|
| 90968 | 12/1937 | Sweden | 213/77 |

*Primary Examiner*—Robert J. Oberleitner
*Assistant Examiner*—Kevin D. Rutherford
*Attorney, Agent, or Firm*—E. Miksch

[57] ABSTRACT

An improved coupler control circuit board which can be positioned in an environmentally protected location for controlling an uncoupling operation of a mechanical type coupler mechanism utilized to connect adjacently disposed ends of a pair of passenger transit type railway cars. Such coupler control circuit board includes a power supply device connected to receive a predetermined input voltage. The power supply device reduces such predetermined input voltage received therein to a suitable predetermined output voltage. A timer/sequencer device is connected to receive as inputs thereto both such predetermined output voltage from such power supply device and an uncoupling command signal from a momentary input command for providing a pair of output signals. A first relay driver is connected to receive a first one of such pair of output signals from such timer/sequencer device for providing an uncoupling output signal, and a second relay driver is connected to receive a second one of such pair of output signals from such timer/sequencer device for providing a coupling output signal.

20 Claims, 6 Drawing Sheets

TIMED THRUST UNCOUPLING MECHANISM FOR PASSENGER TRANSIT TYPE RAILWAY CARS

FIELD OF THE INVENTION

The present invention relates, in general, to an automatic mechanical type coupling mechanism secured to one end of a railway car which is designed to be utilized as passenger transit type vehicle and, more particularly, this invention relates to an automatic mechanical type coupling mechanism having a significantly improved timed thrust uncoupling control circuit board portion, which forms an integral portion thereof, for enabling the automatic disconnecting of the adjacently disposed and mechanically coupled ends of a pair of passenger transit type railway cars, disposed in a train consist which includes at least two railway cars, to be achieved incident to an uncoupling demand input signal being received thereby.

BACKGROUND OF THE INVENTION

Prior to the development of the present invention, as is quite well recognized in the passenger transit type railway car automatic mechanical type coupling art, most railway type passenger transit cars have generally been equipped to enable an automatic mechanical uncoupling of any pair of connected mechanical type couplers which may be disposed intermediate any predetermined pair of passenger transit type railway cars located within a train consist to be accomplished.

The normal operation of such prior art automatic mechanical type coupling mechanisms, during an uncoupling sequence thereof, is usually accomplished by the initiation of an application of a predetermined torque either in a direct fashion or in an indirect fashion to the shaft member of such mechanical type coupling mechanism. In the past, such predetermined torque, which is being applied to such shaft member, will be a torque which is at least sufficient to accomplish the rotational displacement of such shaft member. At that point in time, i.e., when such rotational displacement of the shaft member has been completed it will cause the mechanical type coupling mechanism to become disengaged and thereby permit the adjacently disposed ends of the railway cars to separate.

In the presently available prior art type of electrically operated automatic mechanical type coupling mechanisms, which are known to applicants to be in use, there is an electric motor utilized to provide the requisite amount of power required to accomplish such rotational displacement of such shaft member. In this known mechanical type coupling mechanism, such electric motor, through the utilization of both a predetermined gear reduction and a transformation of the output shaft member in order to sustain a generally parallel orientation to such shaft member of such mechanical type coupling mechanism, causes a rotational movement of an uncoupling cam member which is attached to such output shaft member.

In turn, the above described operating sequence will result in a predetermined torque being applied to a lever mechanism, which is connected to the shaft member of such mechanical type coupling mechanism, and thereby achieving the requisite amount of rotational displacement of such shaft member and the mechanical uncoupling of the adjacently disposed ends of a pair of passenger transit type railway cars.

The required shut-off function for such electric motor is controlled in this prior art mechanical type coupling mechanism arrangement by the use of a limit switch. Such limit switch is positioned in relatively close proximity to the uncoupling cam member and will normally be activated upon the completion of a 360 degree rotation.

One of the most significant problems encountered by the prior art control circuit portions for such mechanical type coupling mechanisms is that such control circuit portions are, by necessity, positioned in a location with respect to such mechanical type coupling mechanism where they will be exposed to a number of undesirable and/or detrimental environmental conditions. The detrimental conditions encountered by such control circuit portions and which are clearly related to the environment will at least include, for example, water and ice. It is known by applicants, for example, that when these particular environmental conditions are present that these prior art control circuit portions have not always been reliable.

In addition, these prior art control circuit portions for a mechanical type coupling mechanism have, in general, been found to require a significant amount of maintenance be performed in order to properly maintain them in both an acceptable and safe operating condition. Obviously, this extraordinary maintenance requirement will add to the overall cost of operating the passenger transit system. Furthermore, at least a first portion of this relatively high maintenance cost is passed on to the passengers who make use of the transit system, while a second portion of such maintenance cost is usually passed on to taxpayers at the local, state and national levels.

It is clear from the above discussion of the known prior art mechanical type coupling mechanisms that a need exists for an improved timed thrust mechanism for use on passenger transit type vehicles which is more reliable regardless of the environment in which it must operate.

SUMMARY OF THE INVENTION

According to a first aspect, the present invention provides an improved coupler control circuit board which can be positioned in an environmentally protected location for controlling as required an uncoupling of a mechanical type coupler mechanism utilized to connect together adjacently disposed ends of a pair of passenger transit type railway cars. Such improved coupler control circuit board includes a power supply means which is connected to receive a predetermined input voltage. This power supply means reduces the predetermined input voltage which is received therein to a suitable predetermined output voltage. There is a timer/sequencer means connected to receive as inputs thereto both such predetermined output voltage from such power supply means and an uncoupling command signal from a remotely located momentary input command device for providing a pair of output signals. A first relay driver is connected to receive a first one of such pair of output signals from the timer/sequencer means. This first relay driver provides an uncoupling output signal. Further, such coupler control circuit board includes a second relay driver which is connected to receive a second one of such pair of output signals from the timer/sequencer means. The second relay driver provides a coupling output signal.

The instant invention further provides, in a second aspect thereof, a timed thrust uncoupling mechanism disposed on a head end portion of a mechanical type coupling mechanism utilized to mechanically connect together adjacently disposed ends of a pair of passenger transit type railway cars. Such timed thrust uncoupling mechanism includes a first means rotatably positioned on such head end portion of such mechanical type coupling mechanism for providing separation and coupling of a pair of adjacently disposed mechanical type coupling mechanisms. A thrust motor is secured to such head end portion of such mechanical type coupling mechanism. Another means engageable with said thrust motor and such head end portion of such mechanical type coupling mechanism is provided for both rigidly and removably securing such thrust motor to such head end portion. There is an uncoupling lever secured to such first means. A thrust type clevis and roller combination is disposed at one end of such thrust motor in a position to enable the roller portion of such thrust type clevis and roller combination to movably engage a predetermined surface of such uncoupling lever. Additionally, a link member is rotatably and removably engaged the first means to provide both a coupling and an uncoupling capability to such mechanical type coupling mechanism. The timed thrust mechanism, also, includes a coupler control circuit board which is electrically connected to such thrust motor for providing an uncoupling command signal to such thrust motor. The coupler control circuit board includes a power supply means connected to receive a predetermined input voltage. Such power supply means reduces such predetermined input voltage received therein to a suitable predetermined output voltage. There is a timer/sequencer means connected to receive as inputs thereto both such predetermined output voltage from such power supply means and an uncoupling command signal from a momentary input command. Such timer/sequencer means provides a pair of output signals, i.e., a coupling command signal and an uncoupling command signal. A first relay driver is connected to receive a first one of such pair of output signals from such timer/sequencer means for providing an uncoupling output signal, and a second relay driver is connected to receive a second one of said pair of output signals from such timer/sequencer means for providing a coupling output signal.

In a third and final aspect of the present invention, there is provided a mechanical type coupler mechanism utilized to connect together adjacently disposed ends of a pair of passenger transit type railway cars. This mechanical type coupler mechanism includes a shank end portion which is engageable in one end of a passenger transit type railway car and an axially opposed head end portion connected to such shank end portion. Such mechanical type coupling mechanism additionally includes a timed thrust uncoupling mechanism disposed on the head end portion of such mechanical type coupling mechanism. Such timed thrust uncoupling mechanism has been described in some detail supra and, for the sake of brevity, such description will not be repeated here. Further such mechanical type coupling mechanism includes a coupler control circuit board which can be positioned in an environmentally protected location for controlling an uncoupling operation of such mechanical type coupler mechanism. Like the timed thrust uncoupling mechanism, such coupler control circuit board has been described above and such description will not be repeated here.

OBJECTS OF THE INVENTION

It is, therefore, one of the primary objects of the present invention to provide a rail car automatic mechanical type coupling mechanism equipped with a control circuit board portion thereof that can be remotely located in a generally protected environment which is utilized during an uncoupling operation to achieve the mechanical uncoupling of the adjacently disposed ends of a pair of passenger transit type railway cars using a thrust force generated by a thrust motor that is time controlled by the control circuit board portion.

Another object of the present invention is to provide a railway car automatic mechanical type coupling mechanism equipped with a control circuit board portion thereof which can be remotely located in a generally protected environment thereby permitting the disassembly of the internal portions of such mechanical type coupling mechanism, including the mechanical type coupler mechanism itself, independently of the uncoupling thrust motor.

Still another object of the present invention is to provide a railway car automatic mechanical type coupling mechanism equipped with a control circuit board portion thereof which is simpler to maintain in an acceptable operating condition.

Yet another object of the present invention is to provide a railway car automatic mechanical type coupling mechanism equipped with a control circuit board portion thereof which requires less assembly time when compared to prior art type control devices for such mechanical type coupling mechanisms.

A further object of the present invention is to provide a railway car automatic mechanical type coupling mechanism equipped with a control circuit board portion thereof which requires less time to disassemble.

An additional object of the present invention is to provide a railway car automatic mechanical type coupling mechanism equipped with a control circuit board portion thereof which exhibits more reliability than prior art type control devices for such mechanical type coupling mechanisms when exposed to undesirable environmental conditions.

In addition to the numerous objects and advantages of the present invention which have been described above, various other objects and advantages of the control circuit board portion of a mechanical type coupling mechanism will become much more readily apparent to those persons who are skilled in the passenger transit type railway car coupling art from the following more detailed description of the instant invention, particularly, when such description is taken in conjunction with the attached drawing Figures and with the appended claims.

BRIEF DESCRIPTION OF THE PRESENTLY PREFERRED EMBODIMENTS OF THE INVENTION

Figure 1:
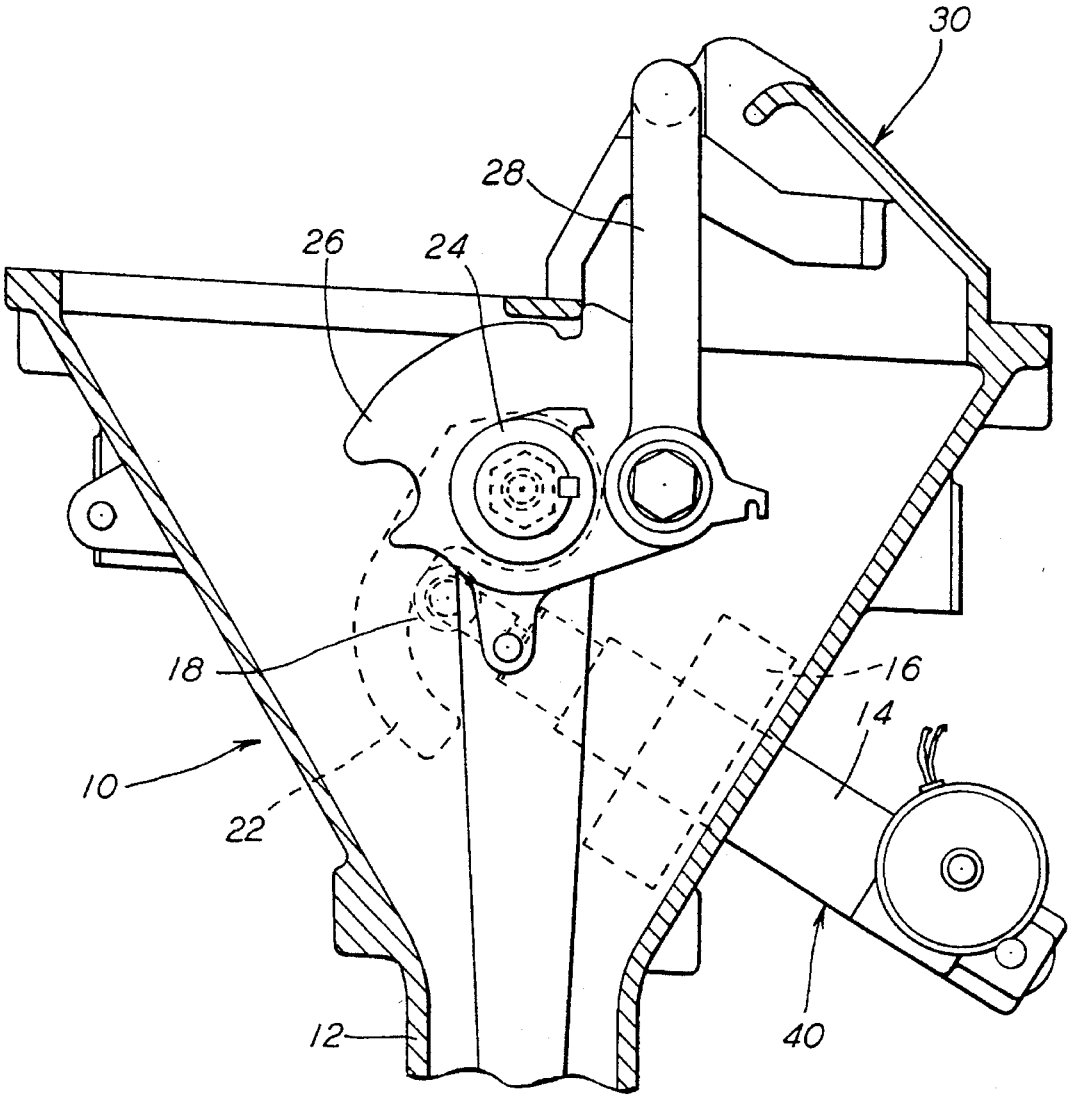
FIG. 1 is a top plan view which illustrates one typical installation of a presently preferred embodiment of a timed thrust uncoupling mechanism, constructed in accordance with the present invention, which has been shown therein in a position which is ready for a mechanical coupling operation with an adjacently disposed mechanical type coupling mechanism.
Figure 2:
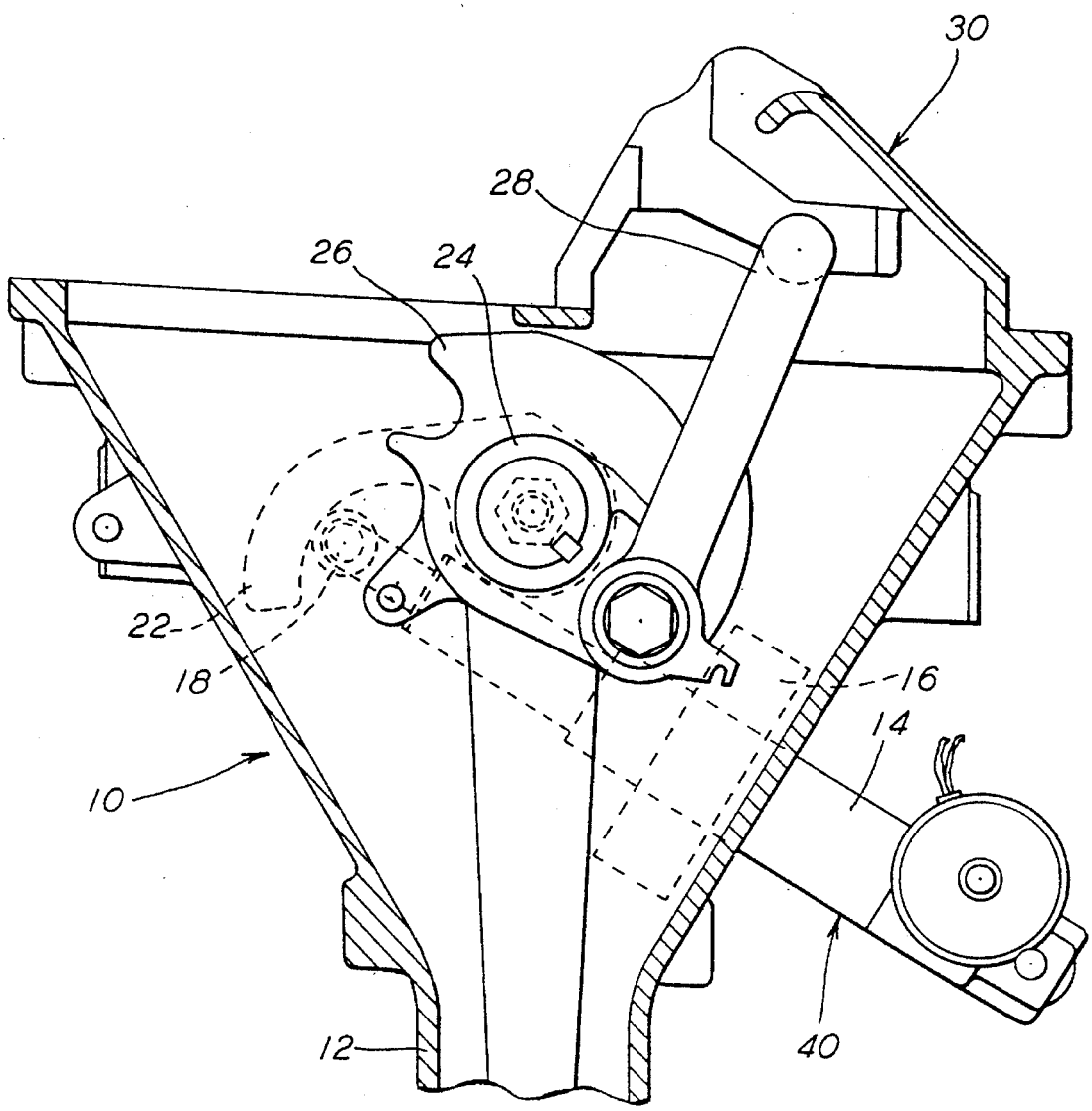
FIG. 2 is a top plan view of the typical installation of the timed thrust mechanism illustrated in FIG. 1 which shows the cam member portion of the mechanical type coupling mechanism rotated to an uncoupling position.
Figure 3:
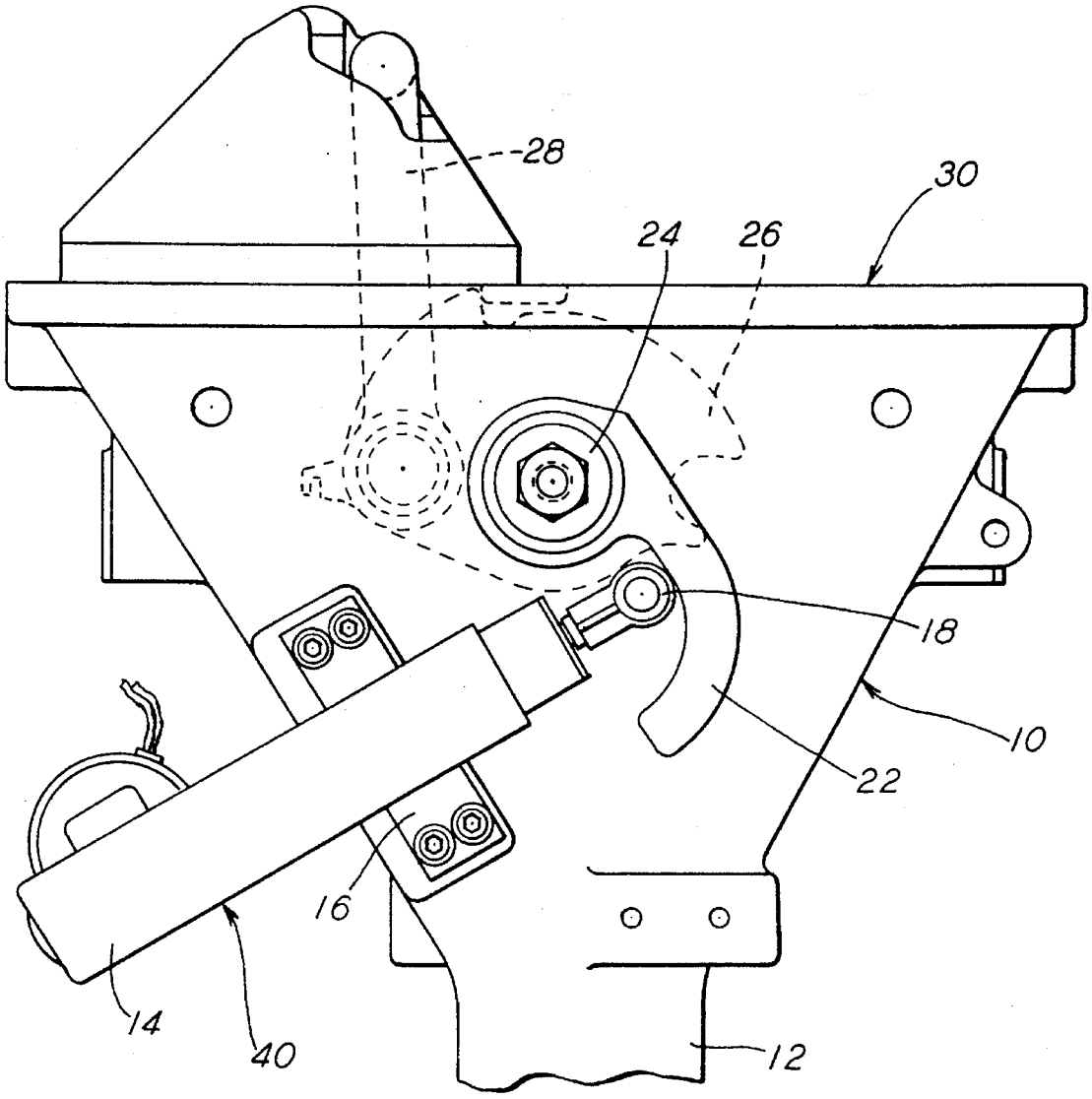
FIG. 3 is a bottom plan view of the typical installation of the timed thrust mechanism illustrated in FIGS. 1 and 2 which shows the cam member portion in a ready for mechanical coupling position.
Figure 4:
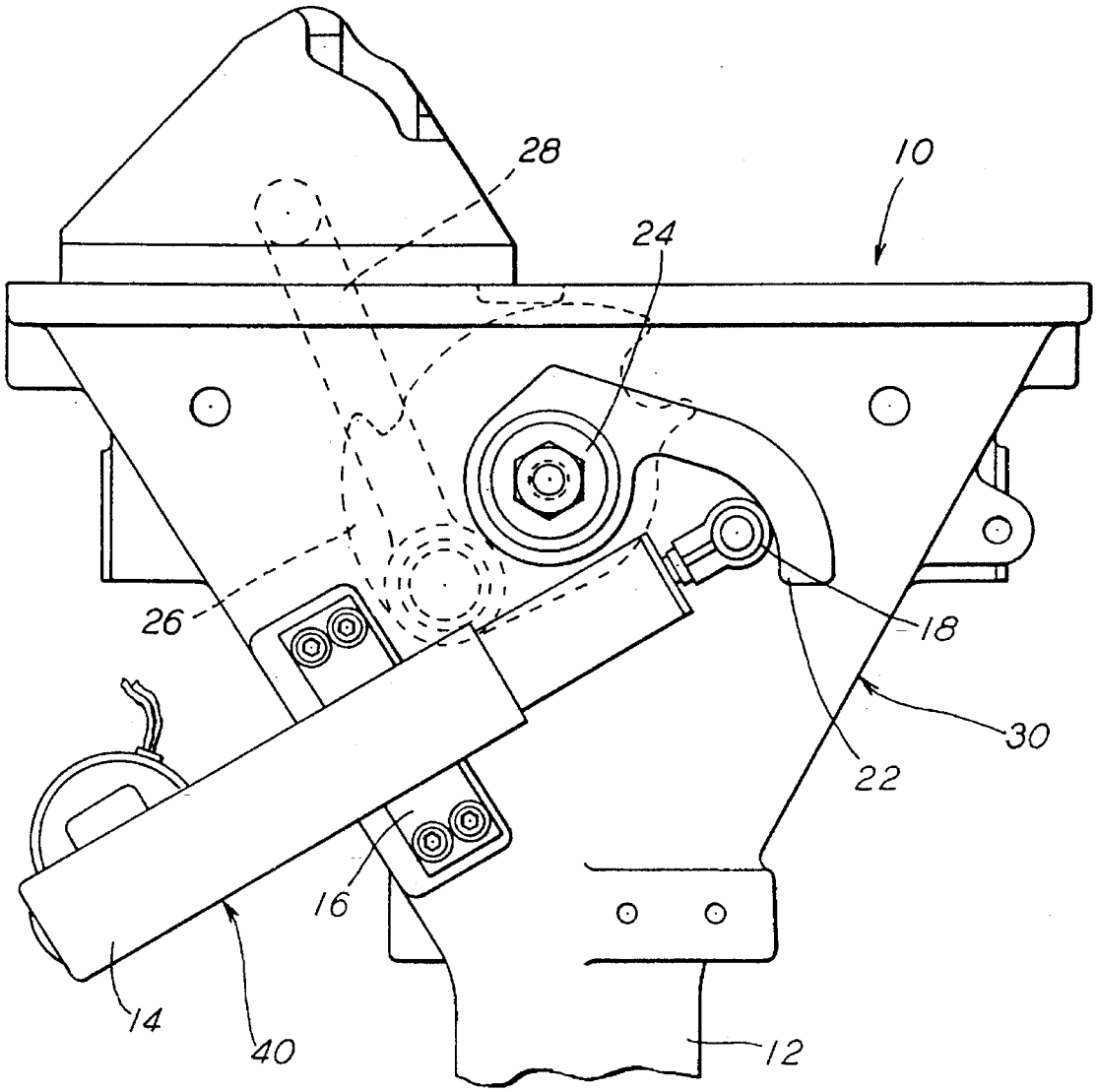
FIG. 4 is a bottom plan view of the typical installation of the timed thrust mechanism illustrated in FIGS. 1 through 3 which shows the cam member portion after it has been rotated to an uncoupling position.
Figure 5:
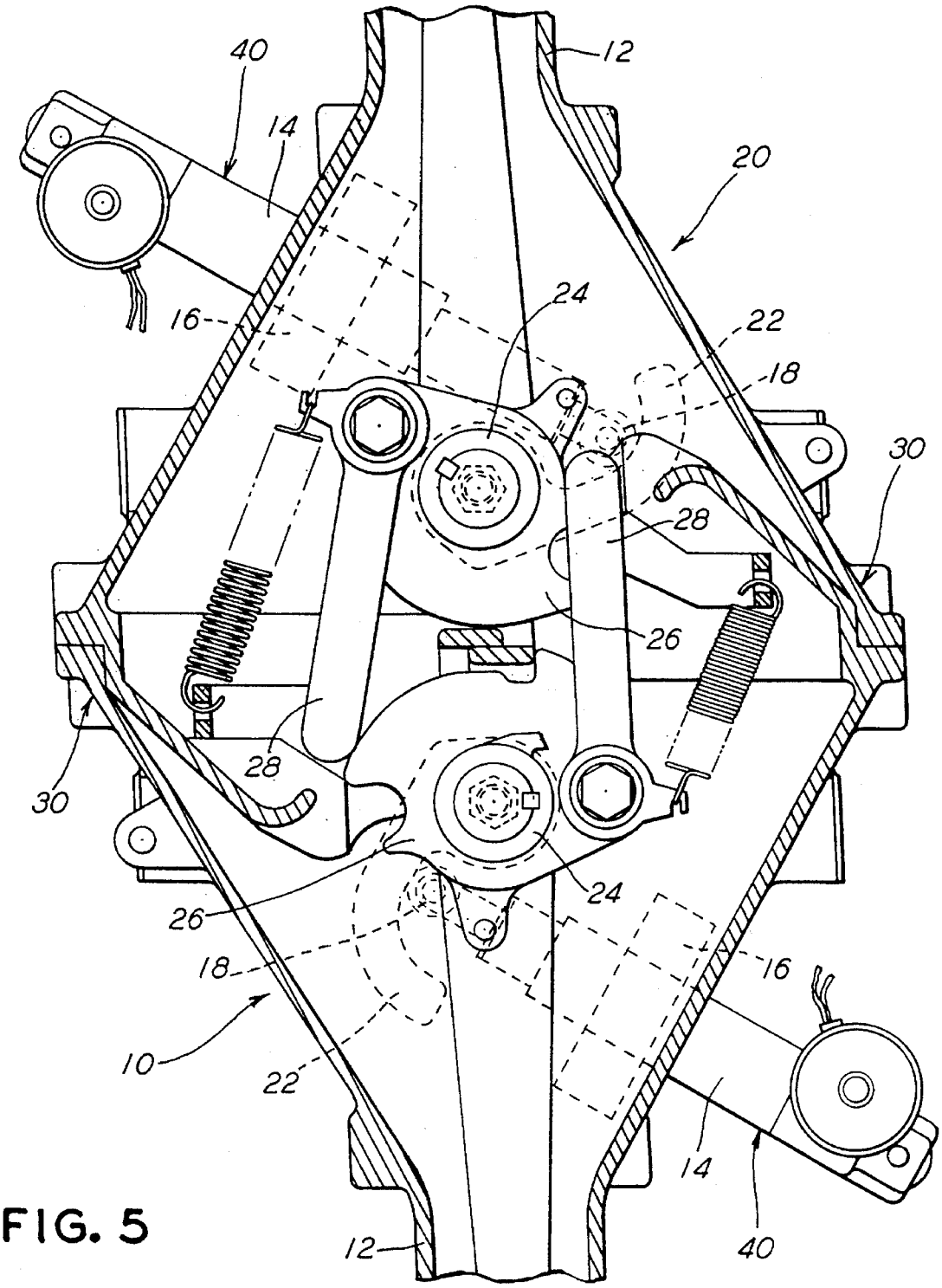
FIG. 5 is a top plan view which illustrates a pair of mated mechanical type coupler mechanisms which have been shown in an uncoupled position ready for separation.

Prior to proceeding to the more detailed description of the instant invention, it should be noted that, for the sake of clarity and understanding such invention, identical components, which have identical functions, have been identified with identical reference numerals throughout the several views which have been illustrated in the drawings.

Now reference is made, more particularly, to each of the drawing FIGS. 1 through 5. Illustrated therein is a presently preferred embodiment of a mechanical type coupling mechanism, generally designated, 10 which is secured to one end (not shown) of a passenger transit type railway car (not shown) and is utilized to removably connect together an adjacently disposed end (not shown) of another passenger transit type railway car (not shown) which is similarly equipped with another mechanical type coupling mechanism, generally designated, 20 (FIG. 5) and thereby form a train consist which includes two or more railway cars.

Each respective one of the mechanical type coupling mechanisms 10 and 20 includes both a shank end portion 12 and an opposed head end portion, generally designated, 30. The mechanical type coupling mechanisms 10 and 20 require for an uncoupling to occur, between two adjacently disposed coupled railway cars, that a predetermined thrust force be applied either directly or indirectly to the uncoupling lever 22.

Accordingly, there is provided, in the presently preferred embodiment of the invention, a timed thrust uncoupling mechanism, generally designated, 40 which is connected to such opposed head end portion 30. This timed thrust uncoupling mechanism 40 may include in one form thereof a hook arrangement (not shown) or, as is presently preferred, in another form thereof a cam arrangement to provide as necessary the desired separation of the adjacently disposed mechanical type coupling mechanisms 10 and 20, as has been illustrated in the drawings.

Furthermore, in the typical installation under discussion, such timed thrust mechanism 40 includes a thrust motor 14 which is rigidly secured to such opposed head end portion 30, preferably, by means of a mounting bracket 16. Although the thrust motor 14 is rigidly mounted to the opposed head end portion 30, such mounting bracket 16 provides a convenient means for enabling such thrust motor 14 to be easily removed for general routine maintenance when necessary.

In the presently preferred embodiment, there is a thrust type clevis and roller combination member 18 positioned adjacent to and substantially on the same plane as an uncoupling lever 22. Such uncoupling lever 22 is both secured and keyed on and to a cam shaft member 24. Additionally, a coupling cam member 26 is both secured and keyed on and to such cam shaft member 24. Such coupling cam member 26 is disposed in a position such that it will be rotated simultaneously with any rotation of the uncoupling lever 22 which may occur.

Rotatably and removably engaged with such coupling cam member 26 is a link member 28. The purpose of such link member 28 will become clear as the operation of such mechanical type coupling mechanisms 10 and 20 is described.

Figure 6:
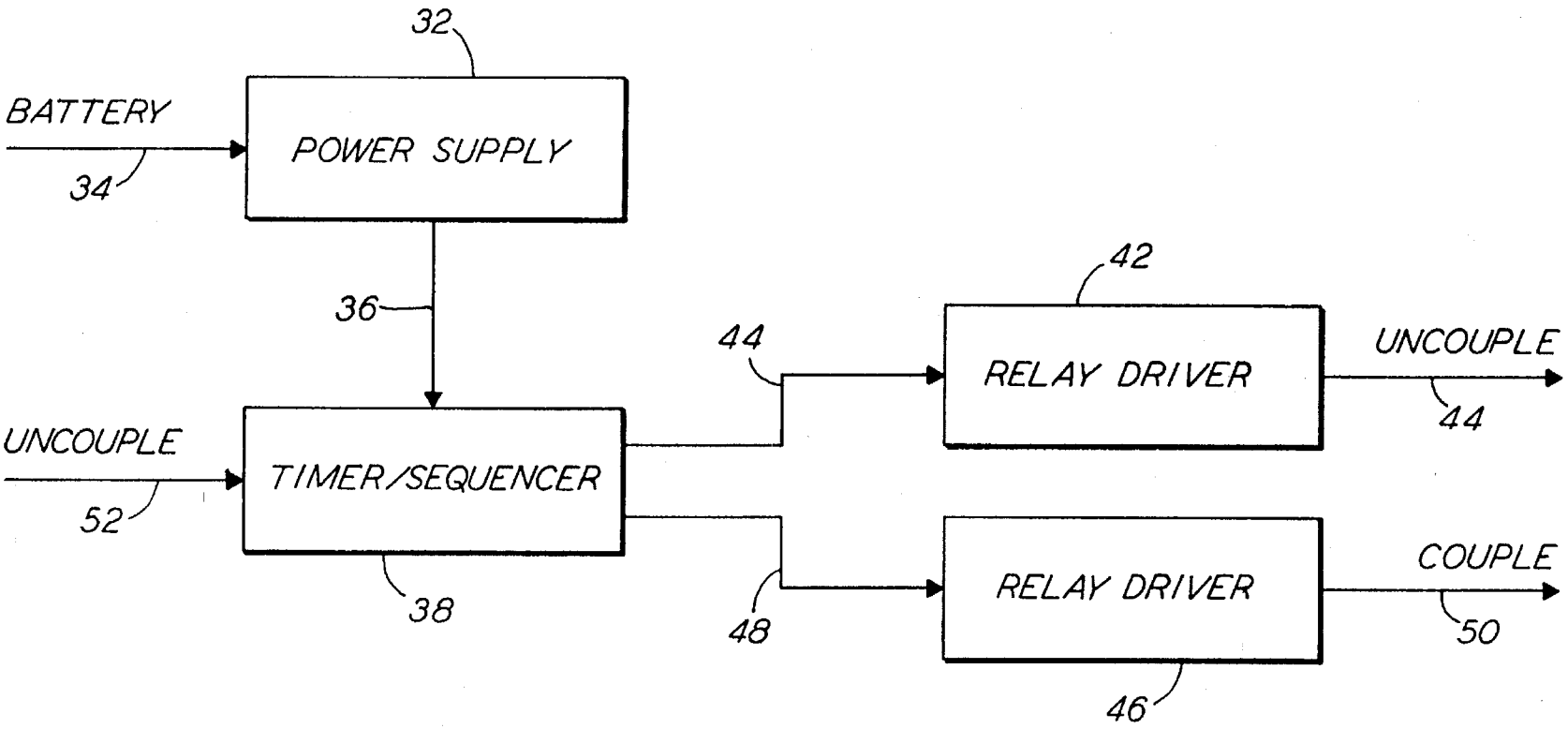
FIG. 6 is a schematic block diagram of the control circuit board for a timed thrust uncoupling mechanism which is constructed in accordance with a presently preferred embodiment of the instant invention.

Reference is now made, more particularly, to FIG. 6 of the drawings. Illustrated therein is a presently preferred embodiment of a coupler control circuit board portion. Such coupler control circuit board portion is located in a remote location that will provide a protected environment and is constructed in accordance with the instant invention. Such coupler control circuit board portion includes a power supply device 32 which is connected to receive as an input a voltage 34 from a battery (not shown). The input voltage 34 from the battery is reduced to a suitable predetermined voltage by the power supply device 32. Preferably, such suitable predetermined voltage will be on the order of substantially about +15 volts. Such predetermined voltage is provided both as an output signal 36 from the power supply device 32 and as one of the input signals to a timer/sequencer device 38. A second input signal which is provided to the timer/sequencer device 38 is an uncoupling command signal 52 which is transmitted by a momentary input command device (not shown) located in the cab portion (not shown) of the train consist.

The coupler control circuit board portion further includes a first relay driver 42 connected to receive an output signal 44 from such timer/sequencer device 38. Such first relay driver 42, upon the receipt of such output signal 44 from the timer/sequencer device 38, provides an uncoupling command output signal 44. Additionally, there is a second relay driver 46 which is connected to receive an output signal 48, also, from the timer/sequencer device 38. This second relay driver 46, upon receipt of such output signal 48 from the timer/sequencer device 38, provides a coupling command output signal 50.

Both the first relay driver 42 and the second relay driver 46 are externally wired, in a manner, such that when such first relay driver 42 is energized then the second relay driver 46 will be essentially blocked from being energized and vice versa. This external wiring of both such first relay driver 42 and such second relay driver 46 is a requirement, in the particular arrangement of the invention being described, because such timer/sequencer device 38 does not include therein any provisions for this type of protection. Each of the first relay driver 42 and the second relay driver 44 is designed to switch the ground on or off to a contact (not shown) that is capable of handling the current of the thrust motor 14. Additionally, the driver circuit of each of the first relay driver 42 and the second relay driver 46 is protected from spikes to prevent damage.

In an uncoupling operation, for example, which assumes that both of such mechanical type coupling mechanisms 10 and 20 (FIG. 5) are in a mechanically coupled condition and that a mechanical uncoupling is desired, the coupler control circuit board portion upon receipt of an appropriate uncoupling command signal 52, will initiate an uncoupling sequence of events.

In the first event, such thrust motor 14 will be energized for a predetermined period of time. Energizing such thrust motor 14 results in a second event that causes the thrust type clevis and roller combination member 18 to advance and rotate the uncoupling lever 22, cam shaft member 24 and coupling cam member 26. Such advancement and rotation of the uncoupling lever 22, cam shaft member 24 and coupling cam member 26 results in a third event that causes the dislodgement of such link member 28 from such coupling cam member 26. This dislodgement of such uncoupling lever 28 from the coupling cam member 26 accomplishes the fourth and final event of uncoupling such mechanical type coupling mechanisms 10 and 20. After a relatively short period of time the relay driver 46 is activated which results in the thrust motor 14 returning to it's starting position, i.e., a ready for coupling position.

It is important to note that in the event such timer/sequencer device 38 gets out of phase with the mechanical type coupler mechanisms 10 and 20, all that would be required is to re-activate the uncoupling sequence and such timer/sequencer device 38 will be reset in approximately 15 seconds. This design feature is deemed to be of critical importance because it eliminates the requirement for environmentally unprotected limit switches to accomplish this function.

While both a number of presently preferred and alternative embodiments of the present invention have been described in detail above with particular reference to the drawing Figures, it should be understood that various other modifications and adaptations of this invention can be made by those persons who are skilled in the mechanical type coupling art for passenger transit type railway cars without departing from the spirit and scope of the appended claims.

We claim:

1. An improved coupler control circuit board which can be positioned in an environmentally protected location for controlling an uncoupling of a mechanical type coupler mechanism utilized to connect together adjacently disposed ends of a pair of passenger transit type railway cars, said coupler control circuit board comprising:

(a) a power supply means connected to receive a predetermined input voltage, said power supply means reducing said predetermined input voltage received therein to a suitable predetermined output voltage;

(b) a timer/sequencer means connected to receive as inputs both said predetermined output voltage from said power supply means and an uncoupling command signal from a momentary input command for providing a pair of output signals, said timer/sequencer providing a first one of said pair of output signals for a predetermined period of time sufficient for uncoupling to occur, said timer/sequencer subsequently providing a second signal for placing various parts of such coupler in position for coupling;

(c) a first relay driver connected to receive said first one of said pair of output signals from said timer/sequencer means for providing an uncoupling output signal; and (d) a second relay driver connected to receive said second one of said pair of output signals from said timer/sequencer means for providing a coupling output signal.

2. An improved coupler control circuit board, according to claim 1, wherein said predetermined input voltage received by said power supply means is communicated thereto by a battery.

3. An improved coupler control circuit board, according to claim 2, wherein said suitable predetermined output voltage being transmitted from said power supply means to said timer sequencer means is generally about +15 volts.

4. An improved coupler control circuit board, according to claim 1, wherein said improved coupler control circuit board further includes external wiring of both said first relay driver and said second relay driver, said external wiring being such that when said first relay driver is energized said second relay driver will be blocked from being energized and when said second relay driver is energized said first relay driver will be blocked from being energized.

5. An improved coupler control circuit board, according to claim 4, wherein said improved coupler control circuit board is electrically adapted to be connected to a thrust motor disposed on said mechanical type coupling mechanism and said first relay driver is designed in a manner to switch ground to at least one of an on position and an off position to a contact member capable of handing current supplied to said thrust motor.

6. An improved coupler control circuit board, according to claim 5, wherein said second relay driver is designed in a manner to switch ground to at least one of an on position and an off position to a contact member capable of handing current supplied to said thrust motor.

7. An improved coupler control circuit board, according to claim 1, wherein a driver circuit contained in said first relay driver is designed to be protected against spikes which could cause damage.

8. An improved coupler control circuit board, according to claim 7, wherein a driver circuit contained in said second relay driver is designed to be protected against spikes which could cause damage.

9. A timed thrust uncoupling mechanism disposed on a head end portion of a mechanical type coupling mechanism utilized to mechanically connect together adjacently disposed ends of a pair of passenger transit type railway cars, said timed thrust uncoupling mechanism comprising:

(a) a first means rotatably positioned on such head end portion of such mechanical type coupling mechanism for providing a capability of both coupling and separating a pair of adjacently disposed mechanical type coupling mechanisms;

(b) a thrust motor secured to such head end portion of such mechanical type coupling mechanism;

(c) a second means engageable with said thrust motor and such head end portion of such mechanical type coupling mechanism for both rigidly and removably securing said thrust motor to such head end portion;

(d) an uncoupling lever secured to said first means;

(e) a thrust type clevis and roller combination disposed at one end of said thrust motor in a position to enable a roller portion of said thrust type clevis and roller combination to movably engage a surface of said uncoupling lever;

(f) a link member rotatably and removably engaged said first means to provide coupling and uncoupling capability to such mechanical type coupling mechanism; and (g) a coupler control circuit board electrically connected to said thrust motor for providing uncoupling command signals to said thrust motor, said coupler control circuit board including;

(i) a power supply means connected to receive a predetermined input voltage, said power supply means reducing said predetermined input voltage received therein to a suitable predetermined output voltage, (ii) a timer/sequencer means connected to receive as inputs both said predetermined output voltage from said power supply means and an uncoupling command signal from a momentary input command for providing a pair of output signals, (iii) a first relay driver connected to receive a first one of said pair of output signals from said timer/sequencer means for providing an uncoupling output signal, and (iv) a second relay driver connected to receive a second one of said pair of output signals from said timer/sequencer means for providing a coupling output signal.

10. A timed thrust uncoupling mechanism, according to claim 9, wherein said first means is a cam arrangement.

11. A timed thrust uncoupling mechanism, according to claim 10, wherein said uncoupling lever is keyed to said cam arrangement.

12. A timed thrust uncoupling mechanism, according to claim 9, wherein said second means is a mounting bracket.

13. A timed thrust uncoupling mechanism, according to claim 12, wherein said mounting bracket provides a capability of removing said thrust motor from such head end portion of such mechanical type coupling mechanism.

14. A timed thrust uncoupling mechanism, according to claim 9, wherein said predetermined input voltage received by said power supply means is communicated thereto by a battery.

15. A timed thrust uncoupling mechanism, according to claim 14, wherein said suitable predetermined output voltage being transmitted from said power supply means to said timer sequencer means is generally about +15 volts.

16. A timed thrust uncoupling mechanism, according to claim 9, wherein said coupler control circuit board further includes external wiring of both said first relay driver and said second relay driver, said external wiring being such that when said first relay driver is energized said second relay driver will be blocked from being energized and when said second relay driver is energized said first relay driver will be blocked from being energized.

17. A timed thrust uncoupling mechanism, according to claim 16, wherein both said first relay driver and said second relay driver are designed in a manner to switch ground to at least one of an on position and an off position to a contact member capable of handing current supplied to said thrust motor.

18. A timed thrust uncoupling mechanism, according to claim 9, wherein a driver circuit contained in each of said first relay driver and said second relay driver is designed to be protected against spikes which could cause damage.

19. A mechanical type coupler mechanism utilized to connect together adjacently disposed ends of a pair of passenger transit type railway cars, said mechanical type coupler mechanism comprising:

(a) a shank end portion engageable in one end of a passenger transit type railway car;

(b) an axially opposed head end portion connected to said shank end portion;

(c) a first means rotatably positioned on said head end portion of said mechanical type coupling mechanism for providing a capability of both coupling and separating a pair of adjacently disposed mechanical type coupling mechanisms;

(d) a thrust motor secured to said head end portion of said mechanical type coupling mechanism;

(e) a second means engageable with said thrust motor and said head end portion of said mechanical type coupling mechanism for both rigidly and removably securing said thrust motor to said head end portion;

(f) an uncoupling lever secured to said first means;

(g) a thrust type clevis and roller combination disposed at one end of said thrust motor in a position to enable a roller portion of said thrust type clevis and roller combination to movably engage a surface of said uncoupling lever;

(h) a link member rotatably and removably engaged to said first means to provide coupling and uncoupling capability to said mechanical type coupling mechanism; and (i) a coupler control circuit board electrically connected to said thrust motor for providing an uncoupling command signal to said thrust motor, said coupler control circuit board including;

(i) a power supply means connected to receive a predetermined input voltage, said power supply means reducing said predetermined input voltage received therein to a suitable predetermined output voltage, (ii) a timer/sequencer means connected to receive as inputs both said predetermined output voltage from said power supply means and an uncoupling command signal from a momentary input command for providing a pair of output signals, (iii) a first relay driver connected to receive a first one of said pair of output signals from said timer/sequencer means for providing an uncoupling output signal to said thrust motor, and (iv) a second relay driver connected to receive a second one of said pair of output signals from said timer/sequencer means for providing a coupling output signal to said thrust motor.

20. A mechanical type coupler mechanism, according to claim 19, wherein said shank end portion and said axially opposed head end portion of said mechanical type coupling mechanism are formed as an integral single piece member.

* * * * *